US009151139B2

(12) United States Patent
Burris et al.

(10) Patent No.: US 9,151,139 B2
(45) Date of Patent: Oct. 6, 2015

(54) METHOD OF REDUCING DEFLECTION THROUGH A ROD PISTON IN A SUBSURFACE SAFETY VALVE

(75) Inventors: John E. Burris, Sapulpa, OK (US); Grant R. Thompson, Tulsa, OK (US); David Z. Anderson, Tulsa, OK (US); James T. Sloan, Tulsa, OK (US); Brock Alan Peoples, Sapulpa, OK (US); Doug A. Lowry, Broken Arrow, OK (US); Anthony S. Coghill, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 736 days.

(21) Appl. No.: 13/151,897

(22) Filed: Jun. 2, 2011

(65) Prior Publication Data

US 2012/0304853 A1 Dec. 6, 2012

(51) Int. Cl.

| | |
|---|---|
| ***F16J 1/00*** | (2006.01) |
| ***E21B 34/10*** | (2006.01) |
| *E21B 34/00* | (2006.01) |

(52) U.S. Cl.

CPC ..... *E21B 34/10* (2013.01); *E21B 2034/005* (2013.01)

(58) Field of Classification Search

CPC ..... E21B 34/10

USPC ..... 92/88, 128, 52, 53; 166/373–375, 66.6, 166/871, 86.1–86.3, 80.1, 108, 166; 403/247, 257; 74/104, 128, 160, 579 R, 74/593

See application file for complete search history.

(56) References Cited

U.S. PATENT DOCUMENTS

| | | | | |
|---|---|---|---|---|
| 3,819,288 | A * | 6/1974 | Carmien | 403/247 |
| 4,658,904 | A * | 4/1987 | Doremus et al. | 166/336 |
| 5,996,469 | A * | 12/1999 | Green | 92/88 |
| 6,581,508 | B2 * | 6/2003 | Kudo et al. | 92/85 R |
| 7,137,452 | B2 * | 11/2006 | McVicker | 166/373 |
| 7,591,317 | B2 * | 9/2009 | Bane et al. | 166/375 |
| 8,256,518 | B2 * | 9/2012 | Guven et al. | 166/331 |
| 2006/0260464 | A1 * | 11/2006 | Sato et al. | 92/88 |
| 2008/0110611 | A1 | 5/2008 | Bane et al. | |
| 2009/0159290 | A1 | 6/2009 | Lauderdale | |
| 2010/0206579 | A1 | 8/2010 | Guven et al. | |
| 2010/0230109 | A1 * | 9/2010 | Lake et al. | 166/332.8 |

FOREIGN PATENT DOCUMENTS

WO 2005008024 A1 1/2005

OTHER PUBLICATIONS

T. Mike Deaton, Schlumberger Advanced Completions Group; "Maximization of Production Capacity in the Big-Bore Completions using Geometrically Optimized Subsurface Safety Valves and Completion Components"; 2000—Offshore Technology Conference May 1-May 4, 2000, Houston, Texas; Paper No. 11882-MS—p. 1.

International Search Report and Written Opinion; International Application No. PCT/US2012/040226; International Filing Date: May 31, 2012; Date of Mailing: Jan. 17, 2013; 9 pages.

* cited by examiner

*Primary Examiner* — Dwayne J White
*Assistant Examiner* — Matthew Wiblin
(74) *Attorney, Agent, or Firm* — Cantor Colburn LLP

(57) ABSTRACT

An actuation assembly including a sleeve member having a radially outwardly extending projection and a piston having an axis, the piston operatively coupled to the projection of the sleeve member and arranged to exert an actuation force on the projection of the sleeve member for actuating the sleeve member, the actuation force positioned about radially aligned with the axis or radially outwardly from the axis.

18 Claims, 7 Drawing Sheets

METHOD OF REDUCING DEFLECTION THROUGH A ROD PISTON IN A SUBSURFACE SAFETY VALVE

BACKGROUND

Pressure-controlled pistons are used to operate subsurface safety valves and other systems in the borehole drilling industry. Some systems include a piston to actuate a flow tube in order to open a closure mechanism, such as a flapper valve. Often, there is a length of the piston that is circumferentially unsupported, which can result in deflection of the piston due to the pressure necessary to keep the closure mechanism in an open position. Deflection is often exacerbated because a radial offset exists between an axis of the piston and an axial surface of the flow tube that engages a coupling on the piston, which results in a bending moment on the piston. Subsurface safety valves are important features in downhole systems and the industry is accordingly desirous of any improvements in the operation of such safety valves.

BRIEF DESCRIPTION

An actuation assembly including a sleeve member having a radially outwardly extending projection; and a piston having an axis, the piston operatively coupled to the projection of the sleeve member and arranged to exert an actuation force on the projection of the sleeve member for actuating the sleeve member, the actuation force positioned about radially aligned with the axis or radially outwardly from the axis.

An actuation assembly including a sleeve member; and a piston having an axis, the piston operatively coupled to the sleeve member and arranged to exert an actuation force on the sleeve member for actuating the sleeve member, the actuation force exerted at a non-planar contact surface.

A method of actuating a component including providing a piston having an axis; providing a sleeve member; coupling the piston to a radially outwardly extending projection of the sleeve member; and actuating the sleeve member by exerting an actuation force on the projection of the sleeve member via the piston, the actuation force positioned about radially aligned with the axis or radially outwardly from the axis.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
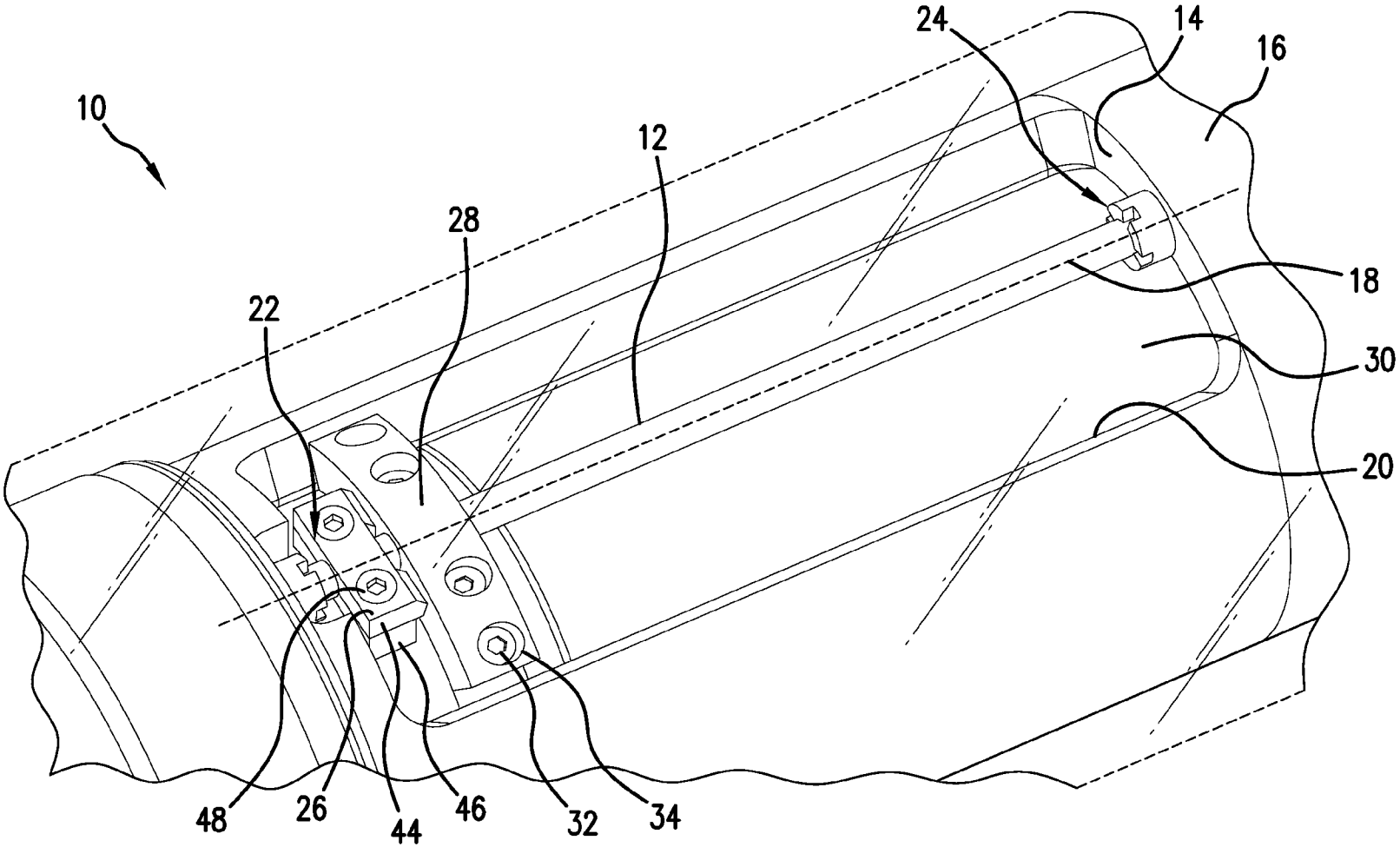
FIG. 1 is a perspective view of an actuation assembly.

Referring now to the drawings, FIG. 1 illustrates an assembly 10 for controlling operation of a subsurface safety valve. The assembly 10 includes a piston 12 that is partially housed within a wall 14 of a housing 16 and slidable along an axis 18. In the embodiment shown in FIG. 1, the housing 16 includes a window 20, with the piston 12 essentially circumferentially unsupported between a first end 22 and a second end 24 of the window 20. It should be understood that the wall 14 includes a first bore and a second bore at the first end 22 and second end 24, respectively, in which bores the piston 12 is slidably engaged for travel along its axis 18.

The window 20 is provided, for example, to accommodate travel of a coupling 26 and a stabilizer 28, also referred to herein as a projection, relative to the housing 16. The coupling 26 is arranged on the piston 12 and used by the piston 12 to transfer forces to a sleeve 30 via the stabilizer 28. The sleeve 30 is exemplified in the drawings as a flow tube, but it is to be appreciated that generally any sleeve, portion of a sleeve, etc. could be loaded by the piston 12 to control operation of a valve or other device. The valve or other device could be any type of device actuatable by a piston. The stabilizer 28 is fixedly secured to the sleeve, via, for example, bolts 32 in corresponding bores 34, welds, etc. In this way, the stabilizer 28 acts as a rigid radial extension of the sleeve 30 for receiving the forces exerted by the piston 12 via the coupling 26. Axial actuation of the sleeve 30 by the piston 12 (via the coupling 26 and the stabilizer 28) is arranged to cause a flapper valve, ball valve, or the like, to open according to known flow tube and/or safety valve systems.

Figure 2:
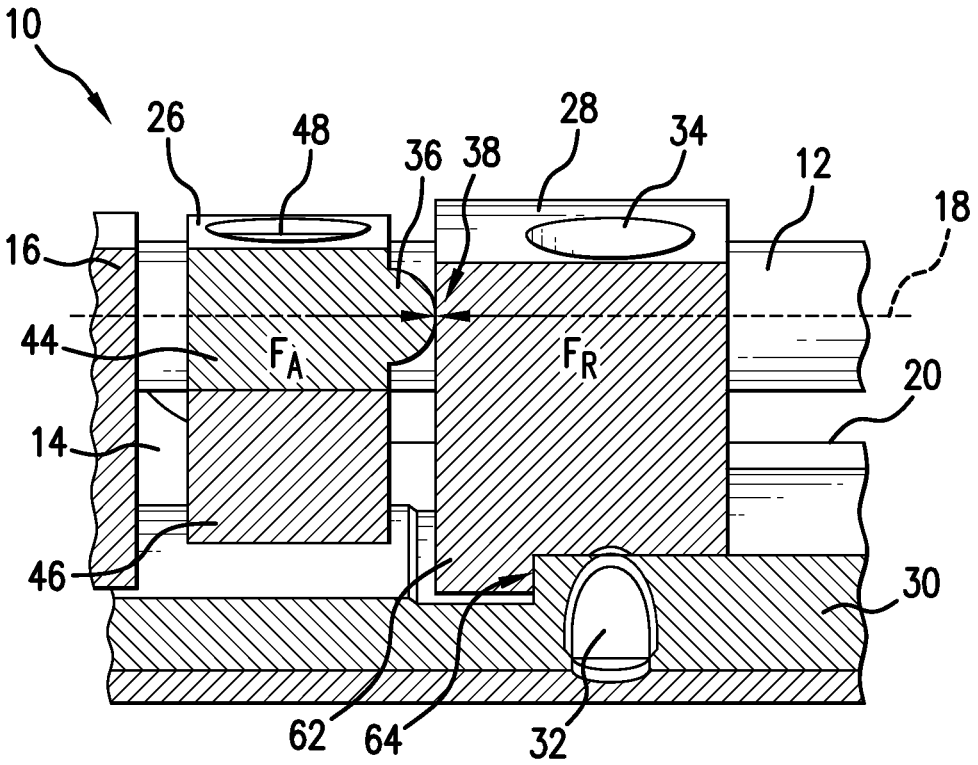
FIG. 2 is a cross-sectional view of the assembly of FIG. 1.
Figure 3:
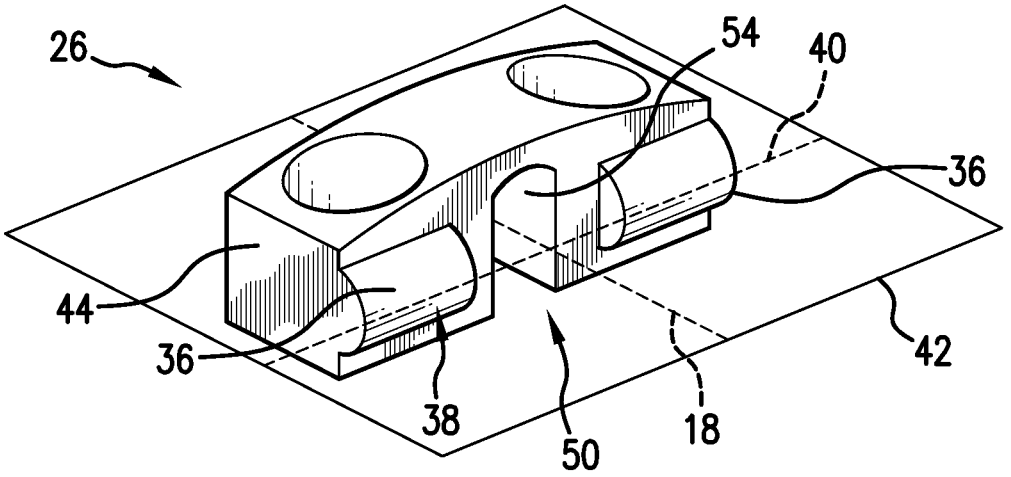
FIG. 3 is a front perspective view of a coupling component for the assembly of FIG. 1.
Figure 4:
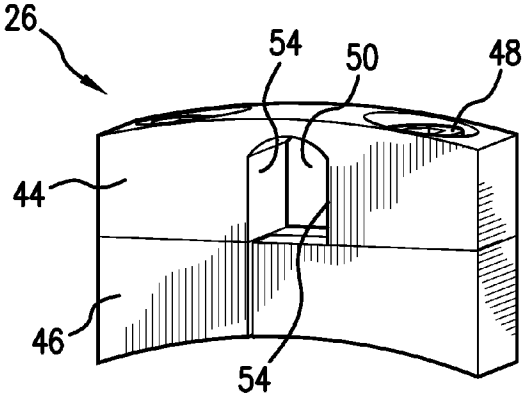
FIG. 4 is a back perspective view of a coupling.
Figure 6:
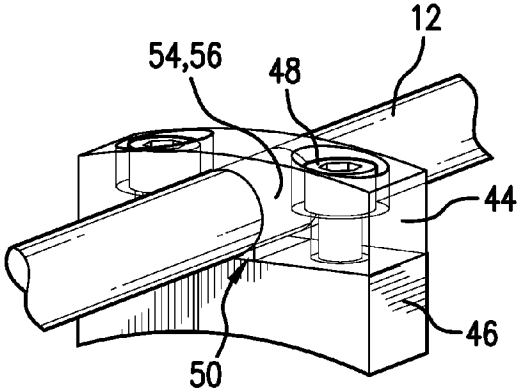
FIG. 6 is a perspective view of the coupling of FIG. 4 installed on the piston of FIG. 5.
Figure 5:
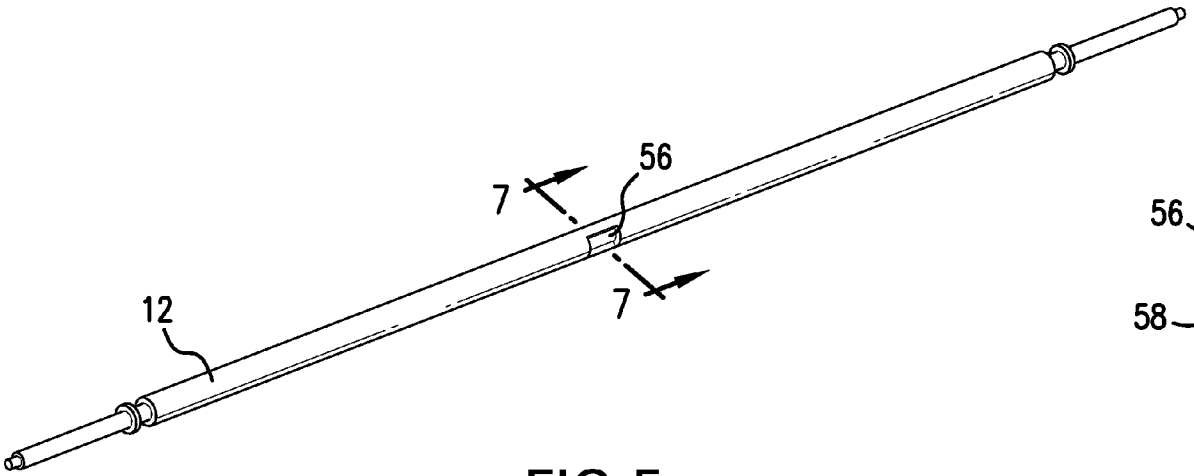
FIG. 5 is a perspective view of a piston.

From FIGS. 2 and 3 it can be more clearly seen how the coupling 26 engages the stabilizer 28 for transferring forces. The coupling 26 includes a pair of protrusions 36 extending therefrom, the protrusions 36 forming a contact surface 38. Each protrusion 36 resembles a semi-circle when viewed in cross-section in FIG. 2 and a half of a cylinder when viewed in perspective in FIG. 3. Since the protrusions 36 are rounded, axially outermost apexes or points of the protrusions 36, as defined along a line 40, essentially define the contact surface 38. The line 40 is perpendicular to the axis 18. Together the line 40 and the axis 18 form a plane 42. The stabilizer 28 extends radially past the plane 42 (and therefore past the line 40 and the axis 18) so that the stabilizer 28 can be engaged by the contact surface 38 of the coupling 26. It is to be appreciated that in other embodiments, protrusions 36 or any such protrusions described herein could be located on the stabilizer facing the coupling.

Advantageously, the contact surface 38 is illustrated in the same plane 42 as the axis 18, so an actuation force $F_A$ exerted by the piston and a reaction force $F_R$ exerted by the stabilizer 28 are aligned with the axis 18 of the piston 12. The force $F_A$ is controllable, for example, by an external control line operatively connected to the piston 12 or a piston chamber for the piston 12 that can be supplied with a pressurized fluid or the like. There exists no radial offset between the forces $F_A$ and $F_R$ (since they are aligned with the axis 18), which results in essentially no bending moment exerted on the piston 12. Since there are two protrusions 36 located on opposite sides of the piston 12 from each other, it is to be noted that the resultant actuating and reaction forces are coaxially aligned with the axis 18, at the midpoint between the protrusions 36.

A purpose of the current invention is to maintain alignment of the actuation and reaction forces with the axis 18 of the piston 12. However, it is to be appreciated that perfect alignment is not always practical or even possible, due to manufacturing tolerances, errors, shifting of components under load, etc. It is to be appreciated in view of the description herein that protrusions 36 that are curved, tapered, pointed, etc., are particularly well suited for alleviating any problems due to misalignment of components while maintaining the contact surface along a line substantially perpendicular to, and aligned in the same plane as, the axis 18. For example, the cross-sectional shape of each protrusion 36 could be triangular, ellipsoidal, spherical, etc. Providing protrusions that are tapered, curved, etc., such as protrusions 36, helps to ensure that even if the coupling 26 and/or stabilizer 28 rotate to some degree relative to each other (or are otherwise misaligned, such as due to manufacturing defects or tolerances), the contact surface 38 will nevertheless be located on the protrusion 36, and therefore very close to maintaining alignment with the axis 18.

Further, the contact surface does not need to be continuous, but could be formed from a plurality of point contacts (e.g., spherical protrusions) arranged along a line, for example. More broadly, it is to be appreciated that other non-planar contact surfaces could be formed by protrusions, and that arrangement along a line is just one embodiment that provides advantages over prior systems. By non-planar contact surface it is intended to mean that two flat, planar surfaces are not matingly engaged to form the contact surface, not that the contact surface can not be formed in a plane. For example, a plurality of point contact surfaces (e.g., from a plurality of spherical protrusions) could be arranged in a pattern (e.g., a grid) for forming a contact surface as a plurality of lines that are all located in a plane, but the surface formed by these point contacts is non-planar.

In view of the foregoing, it is to be understood that while it is stated herein that in some embodiments the actuation and/or reaction forces are "perpendicular to" or "aligned in the same plane as" the axis 18, this may not always be possible or practical and that at least some degree of misalignment is expected. As described below with respect to FIG. 15, some misalignment may actually be desired to achieve improved results in some embodiments under certain conditions.

The following refers generally to FIGS. 1-7. In order to secure the coupling 26 on the piston 12, the coupling 26 is formed from multiple pieces. For example, a cap 44, which includes the protrusions 36, is fixedly securable to a base 46 via bolts 48 or the like. The base 46 could be rounded, for example, to correspond with the outer diameter of the sleeve 30 for supporting the piston 12 against the sleeve 30 in the radial direction. An opening 50 is formed having two flat side surfaces 54. The flat surfaces 54 are perpendicular to the plane 42. The piston 12 includes a corresponding pair of flat notches 56 that are formed complementarily with respect to the flat surfaces 54 of the coupling 26, such that the rod 12 fits firmly in the opening 50 with the flat surfaces 54 of the opening 50 matingly engaging the flat notches 56 of the piston 12. In one embodiment, the notches 56 are milled flats.

Figure 7:
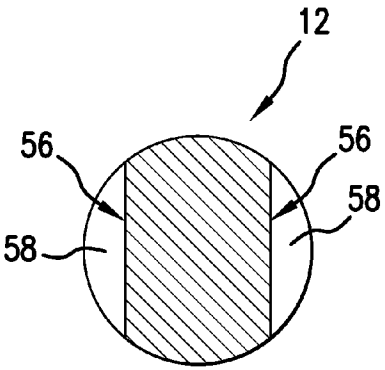
FIG. 7 is a cross-sectional view of the piston taken generally along line 7-7 in FIG. 5.

As shown in the cross-sectional view of FIG. 7, the notches 56 are located substantially equally spaced from the axis 18 of the piston, with a central portion of the piston 12 having no material removed therefrom. In this way, the piston 12 has increased rigidity through the center of the piston 12 than some known pistons that have a turned groove about their entire circumferences. A set of bearing surfaces 58 is also formed from creation of the notches 56. The bearing surfaces are engagable against the coupling in the axial direction for ensuring a high load can be transferred from the piston 12 to the coupling 26. In another embodiment, the piston 12 may be formed as a continuous rod without the notches 56 or the bearing surfaces 58, and the coupling could be secured onto the piston via friction or interference only, such as if the coupling resembled a double split shaft collar.

Figure 8:
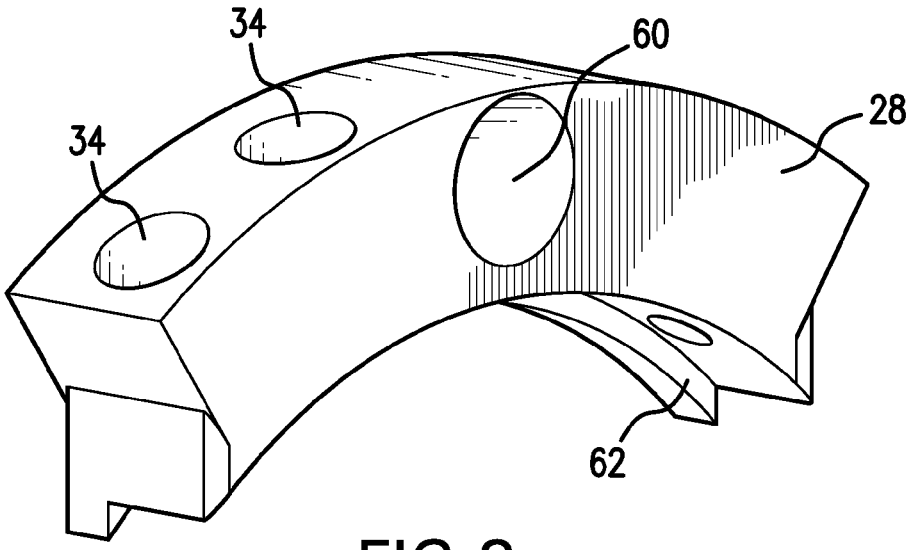
FIG. 8 is a perspective view of a stabilizer in accordance with one embodiment described herein.
Figure 9:
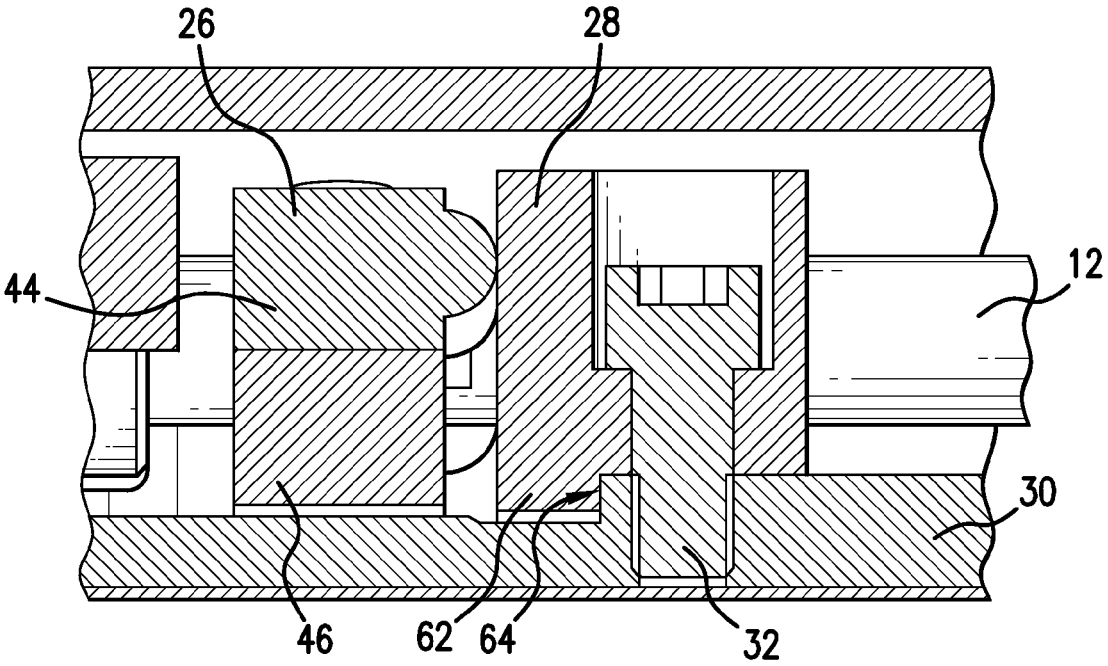
FIG. 9 is a cross-sectional view of a stabilizer fixedly secured to a flow tube.

The stabilizer 28 is shown in more detail in FIGS. 8 and 9. The stabilizer 28 includes an opening 60 for receiving the piston 12 slidably therethrough. As discussed above, the stabilizer 28 is intended to be a rigid radial extension of the sleeve 30, and the plurality of bolts 32 are included in bores 34 for securing the stabilizer 28 to the sleeve 30. The stabilizer also includes a shoulder 62 extending radially inward. The shoulder 62 is intended to engage a lip 64 on the sleeve 30. Conveniently, the shoulder 62 enables a positioning function by setting a proper position of the stabilizer 28 with respect to the sleeve 30 when the shoulder 62 is engaged with the lip 64. Also, the shoulder 62 enables existing flow tubes to be utilized with assemblies according to the current invention. That is, for example, some known flow tube systems include a flow tube with a circumferential lip intended for engaging with a coupling of a piston (which creates the aforementioned radial distance and bending moment). Of course, it is to be realized that the lip 64 and/or the shoulder 62 do not need to be included in some embodiments.

Figure 10:
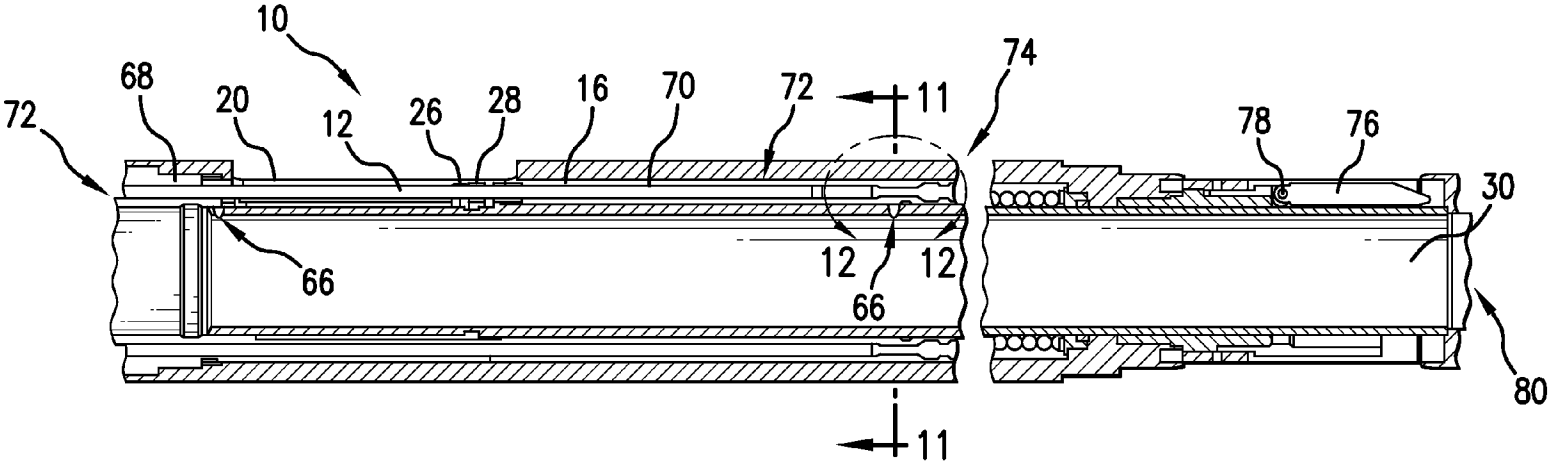
FIG. 10 is a cross-sectional view of a safety valve system including the assembly of FIG. 1.
Figure 12:
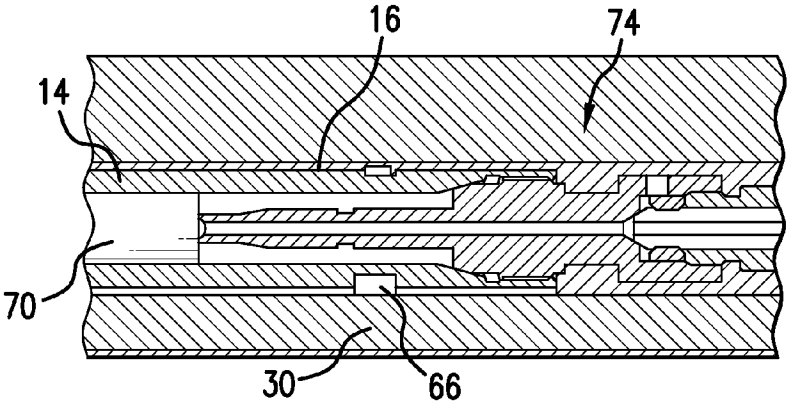
FIG. 12 is an enlarged view of the circumscribed area 12-12 in FIG. 10.
Figure 11:
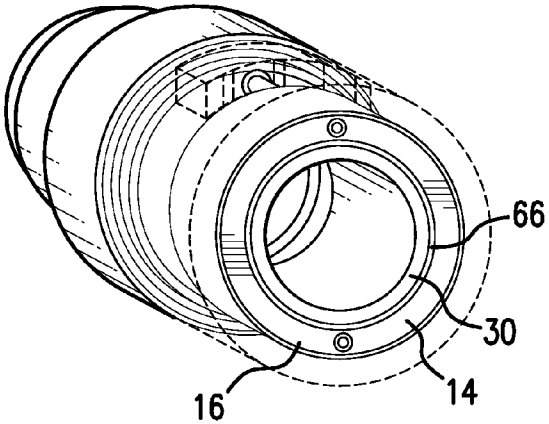
FIG. 11 is a cross-sectional view of the safety valve system taken generally along line 11-11 in FIG. 10.

An even greater reduction in deflection of the piston 12 can be accomplished by maintaining the piston 12 coaxially in the opening 60 of the stabilizer 28. The piston 12 should ideally be able to slide smoothly through the opening 60, so misalignment of the piston 12 with the opening 60 could result in increased friction and/or the piston 12 binding, bending, or otherwise becoming damaged. Since the stabilizer 28 is fixedly secured to the sleeve 30, more firmly setting a position of the sleeve 30 enables better alignment of the piston 12 with the opening 60. One example of an arrangement for maintaining a centered position of the sleeve 30 is shown in FIGS. 10-12. The sleeve 30 is shown engaged within the housing 16, with the piston 12 installed in the wall 14 of the housing 16, as described above. A pair of centering rings 66 is included circumferentially between the sleeve 30 and the housing 16 for centering the sleeve 30 in the housing 16. The rings 66 could each be a bearing, a bushing, a ridge integrally formed with the housing 16 or the sleeve 30, or any other component arranged to center the sleeve 30. In the shown embodiment, the rings 66 are provided at two locations only, as opposed to down the entire length of the sleeve 30, in order to avoid unnecessary friction between the sleeve 30 and the housing 16. It is to be appreciated that the centering rings 66 do not need to be circumferentially continuous, but could include breaks or for example, be formed from a plurality of discrete centering portions in a ring about the circumference of the sleeve 30.

Further details for some embodiments of the assembly 10 can be appreciated in view of FIGS. 10-12. For example, the piston 12 can be seen housed in a first piston bore 68 and a second piston bore 70 in the wall 14 of the housing 16. A pair of dynamic seals 72 is shown, which seals 72 are used to seal the ends of the piston 12. A seal 74 is included to seal the piston bore 70. A flapper valve 76 is also shown in FIG. 10, the flapper valve 76 shown in an open position due to the axial position of the sleeve 30. Upon the sleeve 30 returning to its non-actuated position, the flapper 76 would pivot on a pin 78 in order to block an opening 80 of the sleeve 30 and prevent the flow of fluid through the sleeve 30.

In order to prevent torque on the sleeve 30, it may also be advantageous to circumferentially align the piston 20 with a valve mechanism that is loaded by the sleeve 30 to open the valve. For example, assuming the flapper valve 76 is used, the flow tube would be subjected to higher torque if the piston 12 and the pin 78 for the flapper valve 76 were circumferentially misaligned. In order to ensure alignment of these components, threaded couplings between the piston housing and flapper housing could be clocked or timed so that the pin 78 and the piston 12 are substantially circumferentially aligned when the housings are secured together.

Figure 13:
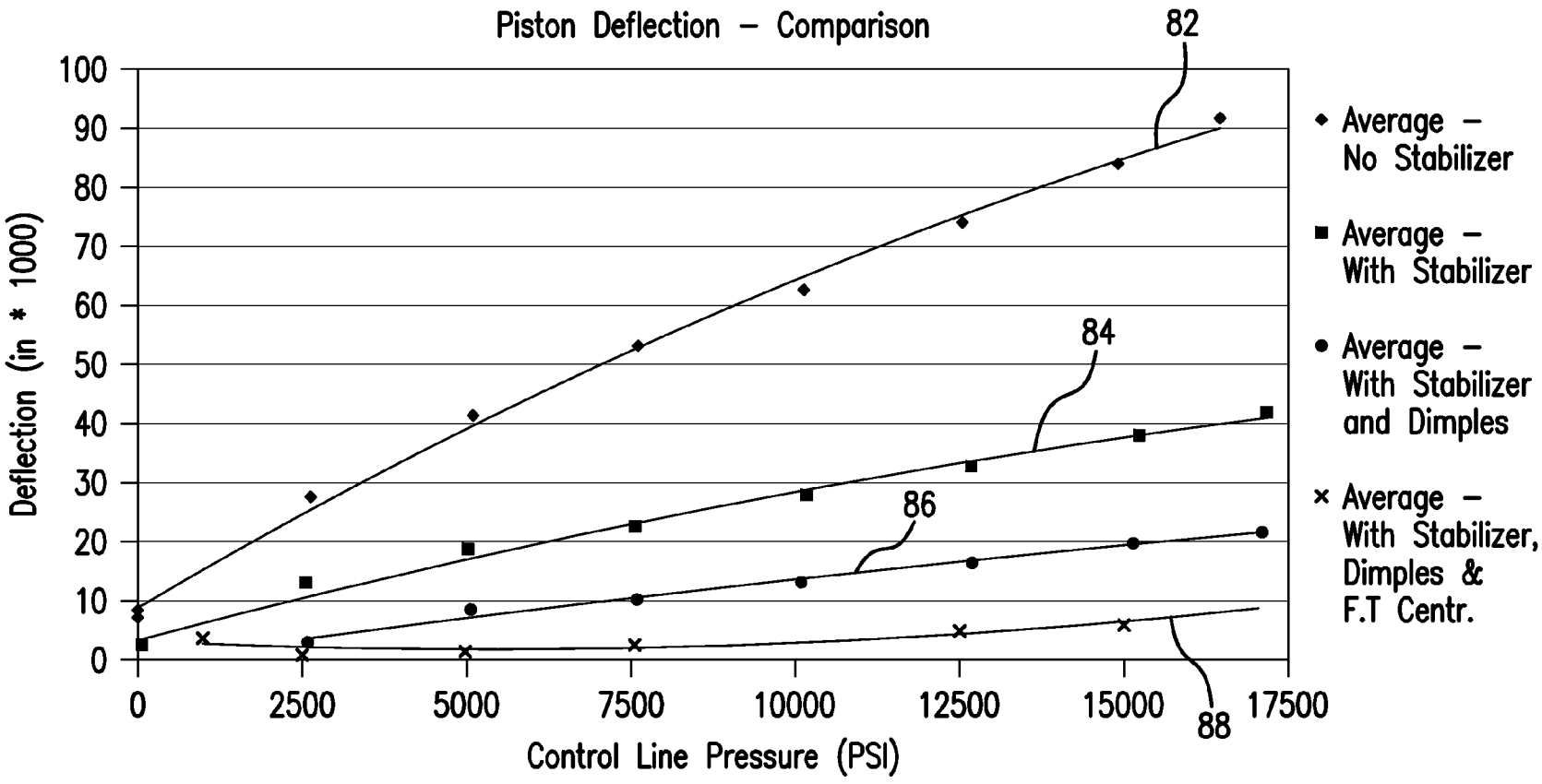
FIG. 13 is a graph illustrating piston deflection for various assemblies with respect to control line pressure.

Several experimental tests were performed to quantify the impact of the various features described herein on deflection of a piston while actuating a flow tube in a subsurface safety valve system. FIG. 13 displays the results of the tests, illustrating the deflection of the piston with respect to a control line pressure exerted on the piston for four different assemblies. A first line 82 depicts the performance of a state of the art piston assembly having a known piston coupling for engaging a flow tube, as discussed in the Background. A second line 84 depicts the performance of a system incorporating a stabilizer, such as the stabilizer 28. A third line 86 depicts the performance of a system including both a stabilizer, such as the stabilizer 28, and a piston coupling having cross-sectionally semi-circular protrusions for engaging the stabilizer, such as the coupling 26 having the protrusions 36. A fourth line 88 depicts the performance of a system including all three of a stabilizer, such as the stabilizer 28, a piston coupling having cross-sectionally semi-circular protrusions for engaging the stabilizer, such as the coupling 26 having the protrusions 36, and a ring circumferentially disposed about a flow tube for centering the flow tube, such as the ring 66 for the sleeve 30. Accordingly, it can be seen that each of these features significantly reduces the amount of deflection of a piston in a safety valve system.

Figure 14:
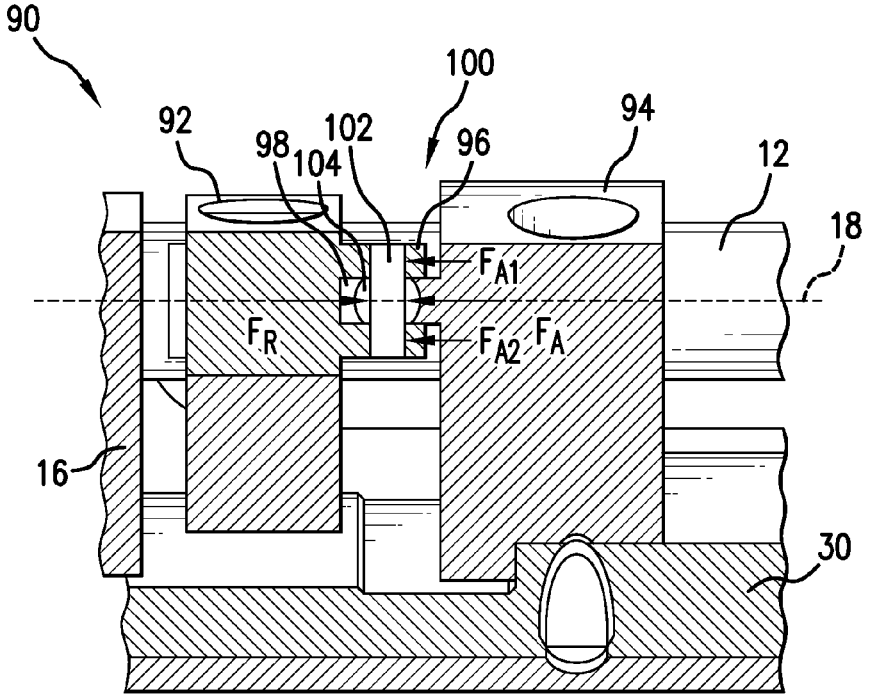
FIG. 14 is a cross-sectional view of another embodiment of an actuation assembly as described herein.

The above embodiments describe a piston that pushes a coupling into a stabilizer. FIG. 14 depicts an assembly 90 in which a coupling 92 on the piston 12 is arranged to also pull a stabilizer 94 that is connected to the sleeve 30. The coupling 92 and the stabilizer 94, respectively, resemble the coupling 26 and the stabilizer 28 in many respects, except that the coupling 92 includes arms 96 and the stabilizer 94 includes arms 98 for forming hinges 100 (one hinge 100 hidden from view, located on the opposite side of the piston 12, similar to the placement of the protrusions 36). Each hinge 100 includes a pin 102 for engaging the coupling 92 to the stabilizer 94, specifically via the arms 96 and 98. The pin 102 could take the form of a bar, block, rod, etc. The coupling 92 exerts an actuation force $F_A$ on the pin 102, which actuation force $F_A$ is exerted by the pin 102 on the stabilizer 94. It is to be recognized that even though there are two components to the actuation force $F_A$, namely components $F_{A1}$ and $F_{A2}$, these components are balanced with respect to the axis 18, so that the resultant force, i.e., actuation force $F_A$, is aligned along the axis 18. As noted above, one hinge 100 is located on each opposite side of piston 12 in order to balance the forces in that direction also. Thus, similar to the above-described embodiments, the resultant actuation force $F_A$ and reaction force $F_R$ are aligned coaxially with the axis 18 of the piston 12 in order to avoid creation of a bending moment on the piston 12.

The hinges could be fully or at least partially articulated to enable some relative movement between the coupling 92 and the stabilizer 94 in order to account for defects, manufacturing tolerances, shifting or rotation due to loads, etc. In one embodiment, for example, the arm 98 of the stabilizer 94 includes a rotatable ball socket 104, through which the pin 102 extends, for enabling some misalignment between the coupling 92 and the stabilizer 94 in any direction. Alternatively, the pin 102 could be fixedly secured to the coupling 92, the stabilizer 94, or both.

Figure 15:
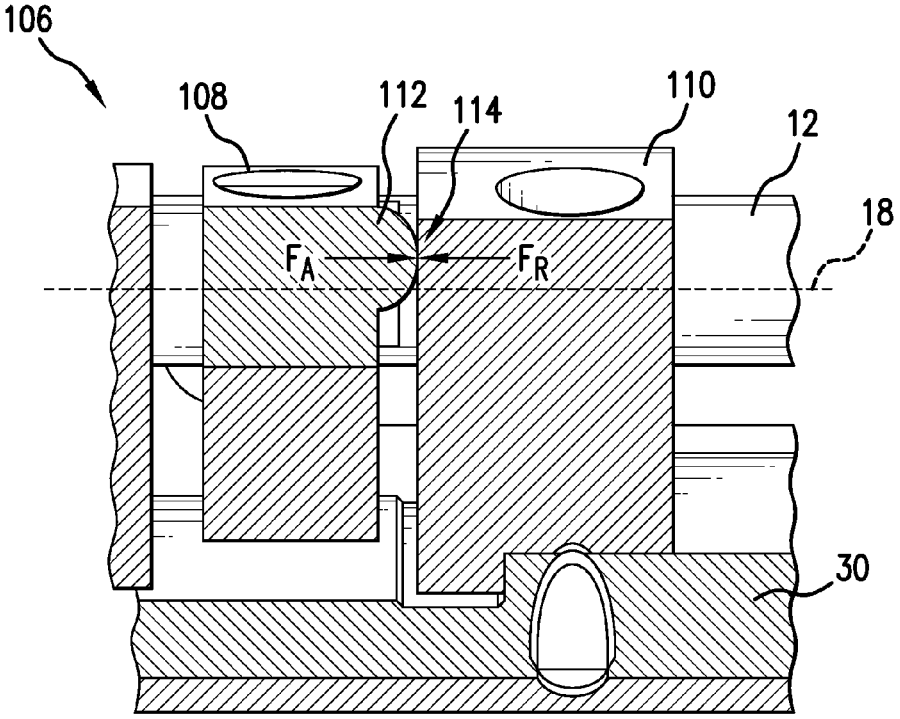
FIG. 15 is a cross-sectional view of another embodiment of an actuation assembly as described herein.

An assembly 106 is shown in FIG. 15. The assembly 106 includes a coupling 108 installed on the piston 12 and a stabilizer 110 fixed to the sleeve 30. The coupling 108 generally resembles the coupling 26, with the exception that a protrusion 112 (or a plurality of protrusions 112) are located radially outwardly from the axis 18 of the piston 12 instead of aligned with the axis 18. The protrusions 112 substantially resemble the protrusions 36 discussed above with the exception of their placement relative to the axis 18. A contact surface 114 is formed between the coupling 108 and the stabilizer 110 such that the actuation and reaction forces, $F_A$ and $F_R$, are positioned radially outwardly from the axis 18. In one embodiment, the stabilizer 110 resembles the stabilizer 28 exactly, and in another embodiment the stabilizer 110 extends further radially with respect to the stabilizer 28 in order to engage properly with the protrusions 114 of the coupling 108.

To an astute reader, it may seem contradictory in view of the above disclosure to create a radial offset between the actuation and reaction forces $F_A$ and $F_R$ and the axis 18 of the piston 12, when it was previously stated such a radial offset was responsible for creating a moment that increased deflection of a piston. However, it is to be appreciated that the natural tendency of such sleeve actuation pistons is typically to buckle in a generally radially outward direction, due to, for example, the arrangement of the system. Thus, aligning the actuation and reaction forces $F_A$ and $F_R$ with the axis 18 of the piston 12 will virtually eliminate one source of bending moment on the piston, but will not account for bending from any other sources. As a result, in some situations positioning the actuation and reaction forces $F_A$ and $F_R$ radially outwardly from the axis 18 of the piston 12 may advantageously create an opposing bending moment to counteract other bending moments on the piston, for even further reducing deflection of the piston 12. Of course, creating too large of a radially outward offset may result in radially inward deflection, so the distance to offset the contact surface 38, 114 from the axis 18, if any, should be determined on a case by case basis. Upon identifying any such moments, an offset for the protrusions could be determined by setting the sum of the moments about the piston axis to zero and solving for the offset. For example, finite element analysis, experimental deflection tests, or other methods may be used to determine other moments and forces on pistons.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. An actuation assembly comprising:

a sleeve member having a radially outwardly extending projection; and a piston having an axis and being located outboard of and nonconcentrically with the sleeve member, the piston being in operable communication with the projection and arranged to exert an actuation force on the projection for actuating the sleeve member, the actuation force from the piston being applied to the projection at a radial position relative to the sleeve member the radial position being no nearer to a center of the sleeve member than the axis of the piston.

2. The assembly of claim 1, wherein the projection is a stabilizer block fixedly secured to the sleeve member.

3. The assembly of claim 1, wherein the projection has an opening for slidably receiving the piston therethrough.

4. The assembly of claim 3, wherein the opening of the projection is maintained coaxially with the axis of the piston by a centering ring arranged circumferentially about the sleeve member.

5. The assembly of claim 1, further comprising a coupling on the piston, the coupling operatively arranged to exert the actuation force on the projection.

6. The assembly of claim 5, wherein the coupling includes at least one protrusion extending axially therefrom with respect to the axis of the piston, the at least one protrusion forming a contact surface, the actuation force exerted at the contact surface.

7. The assembly of claim 6, wherein the at least one protrusion comprises a pair of protrusions disposed on opposite sides of the piston.

8. The assembly of claim 6, wherein the contact surface is formed along a line substantially perpendicular to the axis of the piston.

9. The assembly of claim 8, wherein the line is in a plane with the axis of the piston.

10. The assembly of claim 5, wherein the piston includes at least one flat notch for complementarily engaging with at least one flat surface on an opening of the coupling.

11. The assembly of claim 10, wherein the at least one flat notch comprises a pair of flat notches oppositely disposed and equally spaced from the axis of the piston when the piston is engaged in the opening of the coupling, the at least one flat surface comprising a pair of flat surfaces for matingly engaging with the pair of flat notches.

12. The assembly of claim 1, wherein the sleeve member is a flow tube for actuating a flapper valve.

13. A method of actuating a component comprising:

providing a sleeve member;

providing a piston having an axis and being located outboard of and nonconcentrically with the sleeve member;

aligning the piston to a radially outwardly extending projection of the sleeve member; and actuating the sleeve member by exerting an actuation force on the projection via the piston, the actuation force being applied to the projection at a radial position relative to the sleeve member no nearer to a center of the sleeve member than the axis of the piston.

14. The method of claim 13, wherein the projection is a stabilizer block fixedly secured to the sleeve member.

15. The method of claim 13, wherein the piston includes a coupling for exerting the actuation force.

16. The method of claim 13, wherein the coupling includes at least one protrusion extending axially therefrom, the at least one protrusion forming a contact surface, the actuation force exerted at the contact surface.

17. The method of claim 16, wherein the contact surface is formed as a line.

18. The method of claim 17, wherein the line is in a plane with the axis of the piston and substantially perpendicular to the axis of the piston.

* * * * *